United States Patent [19]

Yu

[11] 4,231,902

[45] Nov. 4, 1980

[54] THERMISTOR WITH MORE STABLE BETA

[75] Inventor: Ruey J. Yu, Flint, Mich.

[73] Assignee: General Motors Corporation, Detroit, Mich.

[21] Appl. No.: 935,874

[22] Filed: Aug. 23, 1978

[51] Int. Cl.[2] ..... H01B 1/06

[52] U.S. Cl. ..... 252/519; 252/520; 338/22 R

[58] Field of Search ..... 252/519, 520; 338/22 R

[56] References Cited

U.S. PATENT DOCUMENTS

| | | | |
|---|---|---|---|
| 3,015,633 | 1/1962 | Humbert et al. | 252/519 |
| 3,341,473 | 9/1967 | Loch | 252/520 |
| 3,430,336 | 3/1969 | Riddel | 29/612 |
| 3,469,224 | 9/1969 | Riddel et al. | 338/22 |
| 3,652,463 | 3/1972 | Riddel | 252/519 |

OTHER PUBLICATIONS

R. J. Yu, "Thermistor with Much Improved Consistency in its Temperature C efficient of Resistance", Research Disclosure item #16129, Col. 2, p. 43, Sep. 10, 1977.

Rao et al., *Transition Metal Oxides-Crystal Chemistry, Phase Transition and Related Aspects,* NSRDS, National Bureau of Standards, Jun. 1974.

*Primary Examiner*—Benjamin R. Padgett
*Assistant Examiner*—J. Lloyd Barr
*Attorney, Agent, or Firm*—Robert J. Wallace

[57] ABSTRACT

A thermistor composition containing zinc oxide, manganese oxide, and cobalt oxide in selected ternary ratios together with small portions of titanium oxide. The titanium oxide addition to the selected ternary ratios of the other three oxides provides a more constant temperature coefficient (beta) over a range of about 300° F. that includes room temperature.

3 Claims, 3 Drawing Figures

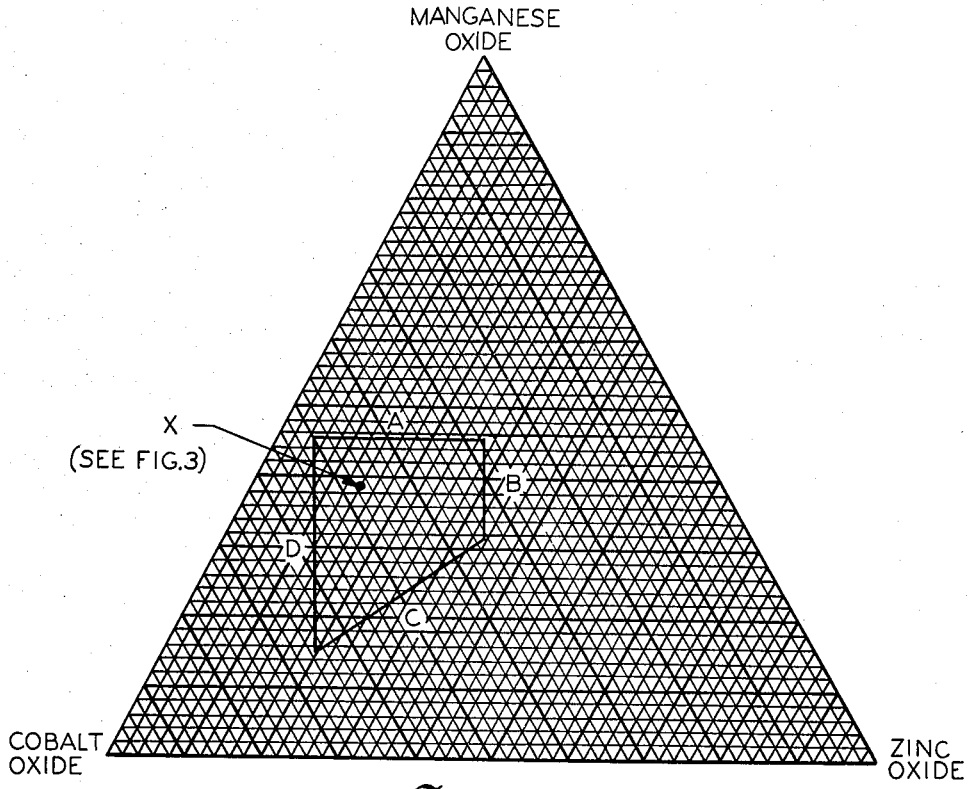
Fig.1
ABCD OF FIGURE.1 PLUS TITANIUM OXIDE
MORE CONSTANT TEMPERATURE COEFFICIENT OF RESISTANCE
Fig.2
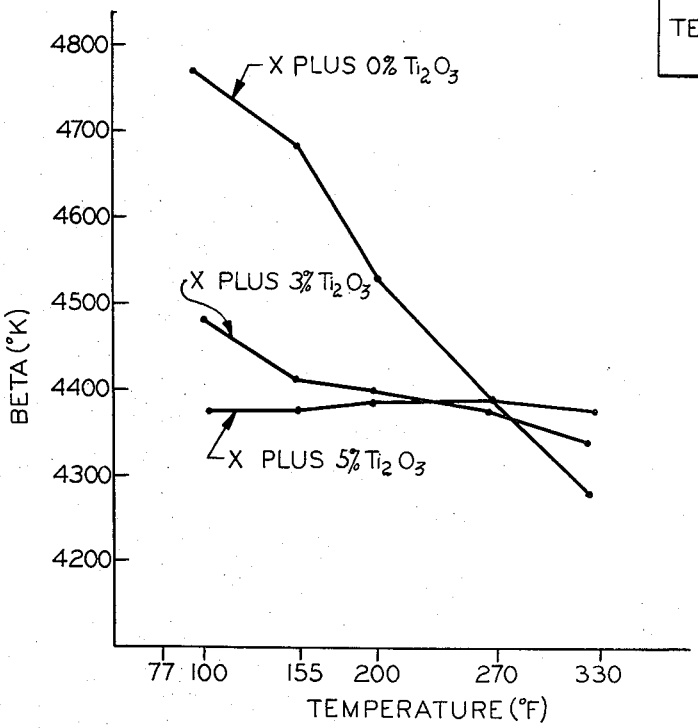
Fig.3

THERMISTOR WITH MORE STABLE BETA

BACKGROUND OF THE INVENTION

This invention relates to thermistors. It more particularly relates to a thermistor composition that provides a more stable temperature coefficient over a wide temperature range.

A thermistor composition consisting essentially of cobalt oxide, manganese oxide, and zinc oxide is disclosed in U.S. Pat. No. 3,652,463 Riddel, assigned to the assignee of the present invention. The Riddel patent discloses particular ternary ratios of such oxides that provide a high temperature coefficient (i.e. beta) for discrete thermistors. These particular compositions can be fired in air and have moderate electrical resistivity, high stability, and good mechanical properties. On the other hand, these compositions generally exhibit a temperature coefficient which changes about 5%–20% over a wide temperature range such as about 50°–350° F. In other words beta is not stable. This produces a corresponding error in temperature measurement based on thermistor resistance change, unless this deviation in beta is compensated. Such compensation would have to be made for each significant span in the temperature range measured. If a computer is used for temperature measurement, considerable memory and extensive computer time is required to perform this compensation. If beta is constant over the temperature range measured, temperature measurement can be done by computer much more simply and quickly.

I have found how to make the temperature coefficient of certain high beta compositions more constant over a wide temperature range without detrimental effects on resistivity, stability or mechanical properties. Temperature measurement with such compositions can now be more simply and quickly done.

OBJECTS AND SUMMARY OF THE INVENTION

One object of this invention is to provide a thermistor composition with a more constant temperature coefficient.

These and other objects of the invention are obtained with a thermistor composition containing selected ternary ratios of cobalt oxide, manganese oxide, and zinc oxide together with a small proportion preferably about 3–6%, by weight, titanium oxide. In essence, the ternary ratios provide a high temperature coefficient (beta) that decreases with increasing temperature. Including small proportions of titanium oxide with such ternary ratios, reduces the temperature coefficient for lower temperatures and increases it for higher temperatures. This provides a generally more constant temperature coefficient.

BRIEF DESCRIPTION OF THE DRAWING

Other objects, features and advantages of the invention will become more apparent from the following description of the preferred examples thereof and from the drawing, in which:

FIG. 1 is a ternary compositional diagram showing selected ratios of the three predominant oxides in my thermistor composition;

FIG. 2 is a block diagram illustrating the titanium oxide addition of this invention; and FIG. 3 is a graph showing the change in temperature coefficient produced by titanium oxide additions according to FIG. 2.

DESCRIPTION OF THE PREFERRED EMBODIMENTS

As mentioned, this invention is an improvement on the prior ternary cobalt oxide-manganese oxide-zinc oxide thermistor compositions. However, to realize the improvement, only a selected few ternary oxide ratios are useful. Most of my ratios are different from those disclosed in the aforementioned U.S. Pat. No. 3,652,463 Riddel. The selected ternary ratios useful in my invention are shown in FIG. 1.

The lines ABCD of FIG. 1 in the drawing of this patent application enclose an area representing selected ternary oxide ratios that can be used in this invention. Such oxide mixtures, when combined with titanium oxide, provide thermistors with temperature coefficients (beta) more constant over 77°–330° F. It is believed that beta will be constant over an even wider range, including 50°–350° F. In the area ABCD, cobalt oxide varies from 27% to 65%. Manganese varies from 15% to 46%. Zinc oxide varies from 4% to 34%. Best results were obtained with more than about 30%, by weight, manganese oxide.

The cobalt oxide is in the form of cobaltic oxide ($Co_2O_3$). However, cobaltous oxide (CoO), or mixtures of the two are expected to be useful. The manganese oxide is manganese sesquioxide ($Mn_2O_3$). However, manganese dioxide ($MnO_2$), manganese trioxide ($MnO_3$), or manganese heptoxide ($Mn_2O_7$) should be substitutable. Titanium oxide means titanium sesquioxide ($Ti_2O_3$). However, other oxides of titanium are expected to be useful too. Since the thermistor composition of this invention is fired in air, the final product should be the same regardless as to the particular cobalt, manganese, zinc or titanium oxide used as a starting ingredient. Analogously, precursors of such oxides may also prove to be useful, particularly if one elects to calcine the mixture prior to pressing and sintering. For example, materials which decompose during calcination into their related oxides, such as carbonates, may prove to be useful in forming the thermistor composition of this invention.

This invention uses ternary ratios of cobalt oxide, manganese oxide and zinc oxide that inherently have a temperature coefficient that decreases with increasing temperature. In general, the compositions denoted within the area ABCD of FIG. 1 exhibit a higher rate of change in electrical resistance at lower temperatures than at higher temperatures. In most instances, the change is gradual and fairly uniform. However, in some instances it is not. In any event, as indicated in FIG. 2, the addition of a few percent by weight of titanium oxide to such compositions tends to prevent this change and confines it within a considerably narrower band. Uniformity in beta is achieved without any significant resistivity change. Moreover, with oxide ratios within the area ABCD, the temperature coefficient is also stable over a long period of time, and the resulting thermistor has good mechanical properties.

By the term temperature coefficient I refer to a material constant which characterizes the average rate of change in electrical resistance of the thermistor composition with change in temperature for a given temperature range. No thermistor compositions are known to applicant which have a constant beta over a wide temperature range. Beta is B in the expression $R = R_O \text{EXP } B/T$ (°K.), where B is the temperature coefficient and is defined as follows:

$$\text{Beta} = \frac{\ln \frac{R_L}{R_H}}{1/T_L - 1/T_H}$$

$R_H$ and $R_L$ are the thermistor resistance (in ohms) measured at the high and low temperatures $T_H$ and $T_L$, which are in degrees Kelvin.

The thermistor examples referred to in FIG. 3 were made according to the following method. A mixture of oxides was initially prepared containing by weight 47% $Co_2O_3$, 39% $Mn_2O_3$ and 14% ZnO. Oxides having a particle passing a 350 mesh are generally suitable. This mixture is represented by point X in FIG. 1. It was divided into three portions to make the preparation of three thermistors referred to in FIG. 3. 5% by weight $Ti_2O_3$ was added to one portion. 3% by weight $Ti_2O_3$ was added to the second portion. No additional oxide was added to the third portion, so that it could serve as a reference composition. Each portion was then separately processed as hereinafter described.

About 1% by weight of bismuth trioxide $Bi_2O_3$ and about 2% by weight of polyvinyl acetate, polyvinyl alcohol or polyethylene glycol binder was added to the portion, together with about ¼% by weight of a lubricant such as napthenic acid. The portion was then dry ball milled for 10 hours, resulting in a particle size having a surface area of about four square meters per gram. After ball milling, about 14% by weight water was added to the portion for granulation. The portion was granulated by successively screening it through a −65 mesh screen and then a −270 mesh screen. The granules were then dried on a tray in an oven at 70° C. for about 15 minutes in air.

The dried granules were then compressed into pellets which are right cylinders having a diameter of approximately 0.2 inch and a thickness of about 0.050 inch. They are pressed under a pressure of 15,000 pounds per square inch, to provide a density of approximately 3.5 grams per cubic centimeter. The pellets were then fired in a furnace open to air, using a heat cycle having a peak temperature of 2000° F., that was held for 2 hours. Warm-up to peak temperature and cool-down is about 8–10 hours or so each. It is believed that an equivalent firing can be obtained in a similar heat cycle where the peak temperature is 1300° C., that is for only ½ hour. Such pressing and sintering of finely ground oxides provides a homogeneous discrete body. After firing, electrodes were formed on each face of the pellet by screen printing a silver-palladium ink. The ink was dried in an oven in air at 150° C. for 10 minutes. After the ink was dried, the pellets were heated at 800° C. for 10 minutes in air, after which the pellets were ready for testing as a complete discrete device. They were tested by measuring resistance between the electroded faces.

FIG. 3 shows the results of testing the thermistor pellets made with the three oxide portions previously referred to. In FIG. 3, the temperature range in which resistance was tested is shown as the abscissa in ° Fahrenheit. Beta is shown as the ordinate in ° Kelvin. Beta was measured for the five consecutive temperature ranges of 77° to 100° F., 100°–155° F., 155°–200° F., 200°–270° F., and 270°–330° F. The uppermost curve is for the ternary oxide portion having no titanium oxide added. As can be seen, beta drops from 4760° K. at 100° to 4270° K. at 330° F. However, when only 3% titanium oxide is added, beta drops to 4440° K. at 100° and increases to 4330° K. at 330° F. 5% titanium oxide provides a beta of 4370° K., 4370° K., 4380° K., 4380° K., and 4370° K. over the five successive temperature ranges. It is believed that this improvement in beta uniformity should be at least extend from about 50° F. to 350° F., a range of about 300 degrees Fahrenheit.

In general, less titanium oxide is needed to stabilize beta for oxide ratios on the left side of the area ABCD than on the right side of the area ABCD. More specifically, only about 1%–3% may be needed for ratios along side D while 6%–8% titanium oxide, and perhaps more, may be needed to stabilize thermistors made with oxide ratios along the side B, particularly closer to side C. Analogously, a lesser titanium oxide content appears to be needed for stabilization of oxide ratios at the top of the area ABCD. For most oxide ratios in this area about 3%–6% by weight titanium and the balance the ternary oxide compositions, seems to be most satisfactory.

It is expected that my thermistor composition can be used to make a thick film printed thermistor, as well as the previously described discrete device. In such instance the previously described pellet-type, discrete device, thermistor body could be pressed and sintered as hereinbefore described. However, before electroding, it would be crushed and ground with organic materials to form a paste. The paste is then screen printed or brushed onto a nonconductive ceramic substrate, dried, and sintered. Sintering as low as about 800° C. may be desired. In the alternative, one need not press and sinter the oxides before preparing the paste. However, if a low temperature of about 800° C. is used in sintering one would then probably prefer to calcine the oxides before preparing the paste. In addition, one may choose to include about 2% $Bi_2O_3$ in the paste as a flux.

It should further be noted that it now appears the compositions of this invention may also be useful in forming low beta thermistors too, with increased beta uniformity. For example, a discrete device thermistor composition such as described herein may be mixed in small proportions (e.g. 15% by weight) with a resistor composition e.g. a resistor ink composition, and sintered at a low temperature, such as 800° C. As with the preceding example of the invention, this low beta composition could be used to form a discrete device, or a thick film device.

The embodiments of the invention in which an exclusive property or privilege is claimed are defined as follows:

1. A thermistor comprising a resistance body composed of cobalt oxide, manganese oxide and zinc oxide in substantially the ratios by weight defined by the area ABCD of FIG. 1, together with about 3–6% by weight titanium oxide providing a predetermined temperature coefficient of electrical resistance, beta, substantially constant from about 50° F. to 350° F., the same being pressed and sintered to form a unitary homogeneous body.

2. A thermistor composition having a more constant temperature coefficient of electrical resistance, beta, over a temperature range of about 50° F. to 350° F., said composition including cobalt oxide, manganese oxide and zinc oxide in substantially a ratio by weight defined by the area ABCD of FIG. 1, together with about 1–8% by weight titanium oxide.

3. A thermistor film containing cobalt oxide, manganese oxide and zinc oxide in substantially a ratio by weight defined by the area ABCD of FIG. 1, together with about 3–6% by weight titanium oxide, said oxides being sintered, whereby said film has a temperature coefficient of electrical resistivity, beta, that is substantially constant from about 50° F. to 350° F.

* * * * *